US010773406B2

(12) United States Patent
Broemse

(10) Patent No.: US 10,773,406 B2
(45) Date of Patent: Sep. 15, 2020

(54) HEATING MEMBER FOR A SHAVING RAZOR

(71) Applicant: The Gillette Company LLC, Boston, MA (US)

(72) Inventor: Norbert Broemse, Bad Homburg (DE)

(73) Assignee: The Gillette Company LLC, Boston, MA (US)

( * ) Notice: Subject to any disclaimer, the term of this patent is extended or adjusted under 35 U.S.C. 154(b) by 322 days.

(21) Appl. No.: 15/866,580

(22) Filed: Jan. 10, 2018

(65) Prior Publication Data

US 2018/0207825 A1 Jul. 26, 2018

(30) Foreign Application Priority Data

Jan. 20, 2017 (EP) ..... 17152537

(51) Int. Cl.
*B26B 21/48* (2006.01)
*H05B 3/36* (2006.01)
*B26B 21/40* (2006.01)

(52) U.S. Cl.
CPC ..... *B26B 21/48* (2013.01); *H05B 3/36* (2013.01); *B26B 21/4056* (2013.01)

(58) Field of Classification Search
CPC ..... B26B 21/48; B26B 21/4056; H05B 3/36
USPC ..... 219/531
See application file for complete search history.

(56) References Cited

U.S. PATENT DOCUMENTS 9,149,945 B2 * 10/2015 Tomassetti ..... B26B 21/48
2003/0046816 A1 * 3/2003 Kanzer ..... B26B 21/40 30/32
2003/0226258 A1 * 12/2003 Patrick ..... B26B 19/382 30/34.05
2010/0031510 A1 2/2010 Gester et al.
2011/0167640 A1 * 7/2011 Flyash ..... A61B 18/082 30/34.05
2014/0245611 A1 * 9/2014 Bohmer ..... B26B 21/48 30/34.05
2015/0174776 A1 * 6/2015 Hawes ..... B26B 21/521 30/526
2015/0197019 A1 * 7/2015 Hodgson ..... B26B 21/227 30/34.05
2015/0298327 A1 * 10/2015 Tomassetti ..... B26B 21/48 30/34.05
2016/0375597 A1 12/2016 Broemse et al.

OTHER PUBLICATIONS

PCT International Search Report with Written Opinion in corresponding international application PCT/US2018/013237 dated Apr. 13, 2018.
U.S. Appl. No. 15/866,596, filed Jan. 10, 2018, Norbert Broemse.
EPO Search Report with Written Opinion in corresponding EPO application 17152537.1 dated Jul. 11, 2017.

* cited by examiner

*Primary Examiner* — Vishal Pancholi
(74) *Attorney, Agent, or Firm* — John M. Lipchitz

(57) ABSTRACT

A heat delivery element for a shaving razor with a heater having a heater track positioned between an upper dielectric layer and a lower dielectric layer. The heater track is secured between the upper dielectric layer and the lower dielectric layer by an adhesive layer bonded to the upper dielectric layer and the lower dielectric layer.

20 Claims, 4 Drawing Sheets

HEATING MEMBER FOR A SHAVING RAZOR

FIELD OF THE INVENTION

The present invention relates to shaving razors and more particularly to heated razors for wet shaving.

BACKGROUND OF THE INVENTION

Users of wet-shave razors generally appreciate a feeling of warmth against their skin during shaving. The warmth feels good, resulting in a more comfortable shaving experience. Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery. Razor blades within a razor cartridge have also been heated. The drawback with heated blades is they have minimal surface area in contact with the user's skin. This minimal skin contact area provides a relatively inefficient mechanism for heating the user's skin during shaving. However, the delivery of more heat to the skin generates safety concerns (e.g., burning or discomfort).

Accordingly, there is a need to provide a shaving razor capable of delivering safe and reliable heating that is noticeable to the consumer during a shaving stroke.

SUMMARY OF THE INVENTION

The invention features, in general, a simple, efficient heat delivery element for a shaving razor with a face plate having a skin contacting surface and an opposing inner surface. A heater having a heater track is positioned between an upper dielectric layer and a lower dielectric layer. A heat dispersion layer having a lower surface directly contacts the inner surface of the face plate. An upper surface of the heat dispersion layer directly contacts the lower dielectric layer of the heater.

In other embodiments, the invention features, in general, a simple, efficient heat delivery element for a shaving razor with a heater having a heater track positioned between an upper dielectric layer and a lower dielectric layer. The heater track is secured between the upper dielectric layer and the lower dielectric layer by an adhesive layer bonded to the upper dielectric layer and the lower dielectric layer.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
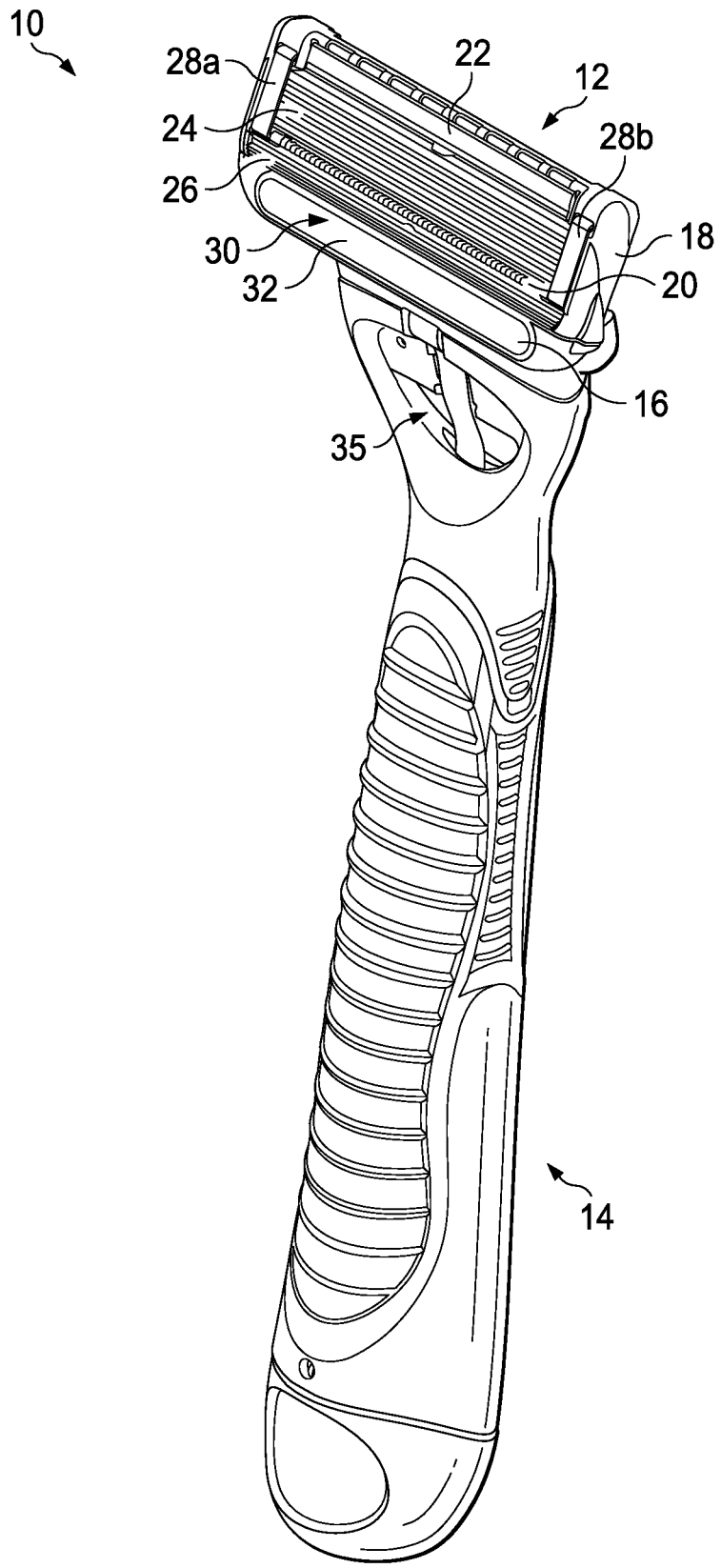
FIG. 1 is a perspective view of one possible embodiment of a shaving razor system.

Referring to FIG. 1, one possible embodiment of the present disclosure is shown illustrating a shaving razor system 10. In certain embodiments, the shaving razor system 10 may include a shaving razor cartridge 12 mounted to a handle 14. The shaving razor cartridge 12 may be fixedly or pivotably mounted to the handle 14 depending on the overall desired cost and performance. The handle 14 may hold a power source, such as one or more batteries (not shown) that supply power to a heat delivery element 16. In certain embodiments, the heat delivery element 16 may comprise a metal, such as aluminum or steel.

The shaving razor cartridge 12 may be permanently attached or removably mounted from the handle 14, thus allowing the shaving razor cartridge 12 to be replaced. The shaving razor cartridge 12 may have a housing 18 with a guard 20, a cap 2,2 and one or more blades 24 mounted to the housing 18 between the cap 22 and the guard 20. The guard 20 may be toward a front portion of the housing 18 and the cap 22 may be toward a rear portion of the housing 18 (i.e., the guard 20 is in front of the blades 24 and the cap is behind the blades 24). The guard 20 and the cap 22 may define a shaving plane that is tangent to the guard 20 and the cap 22. The guard 20 may be a solid or segmented bar that extends generally parallel to the blades 24. In certain embodiments, the heat delivery element 16 may be positioned in front of the guard 20.

In certain embodiments, the guard 20 may comprise a skin-engaging member 26 (e.g., a plurality of fins) in front of the blades 24 for stretching the skin during a shaving stroke. In certain embodiments, the skin-engaging member 24 may be insert injection molded or co-injection molded to the housing 18. However, other known assembly methods may also be used such as adhesives, ultrasonic welding, or mechanical fasteners. The skin engaging member 26 may be molded from a softer material (i.e., lower durometer hardness) than the housing 18. For example, the skin engaging member 26 may have a Shore A hardness of about 20, 30, or 40 to about 50, 60, or 70. The skin engaging member 26 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, skin engaging member 26 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 18 and/or the fins against the skin of the user during shaving.

In certain embodiments, the blades 24 may be mounted to the housing 18 and secured by one or more clips 28*a* and 28*b*. Other assembly methods known to those skilled in the art may also be used to secure and/or mount the blades 24 to the housing 18 including, but not limited to, wire wrapping, cold forming, hot staking, insert molding, ultrasonic welding, and adhesives. The clips 28*a* and 28*b* may comprise a metal, such as aluminum for conducting heat and acting as a sacrificial anode to help prevent corrosion of the blades 24. Although five blades 24 are shown, the housing 18 may have more or fewer blades depending on the desired performance and cost of the shaving razor cartridge 12.

The cap 22 may be a separate molded (e.g., a shaving aid filled reservoir) or extruded component (e.g., an extruded lubrication strip) that is mounted to the housing 18. In certain embodiments, the cap 22 may be a plastic or metal bar to support the skin and define the shaving plane. The cap 22 may be molded or extruded from the same material as the housing 18 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides may have molecular weights of about 100,000 to 6 million, for example, about 300,000 to 5 million. The polyethylene oxide may comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

The heat delivery element 16 may include a face plate 30 for delivering heat to the skin's surface during a shaving stroke for an improved shaving experience. In certain embodiments, the face plate 30 may have an outer skin contacting surface 32 comprising a hard coating (that is harder than the material of the face plate 30), such as titanium nitride to improve durability and scratch resistance of the face plate 30. Similarly, if the face plate 30 is manufactured from aluminum, the face plate 30 may go through an anodizing process. The hard coating of the skin contact surface may also be used to change or enhance the color of the skin contacting surface 32 of the face plate 30. The heat delivery element 16 may be mounted to either the shaving razor cartridge 12 or to a portion of the handle 14. As will be described in greater detail below, the heat delivery element 16 may be mounted to the housing 18 and in communication with the power source (not shown).

Figure 2:
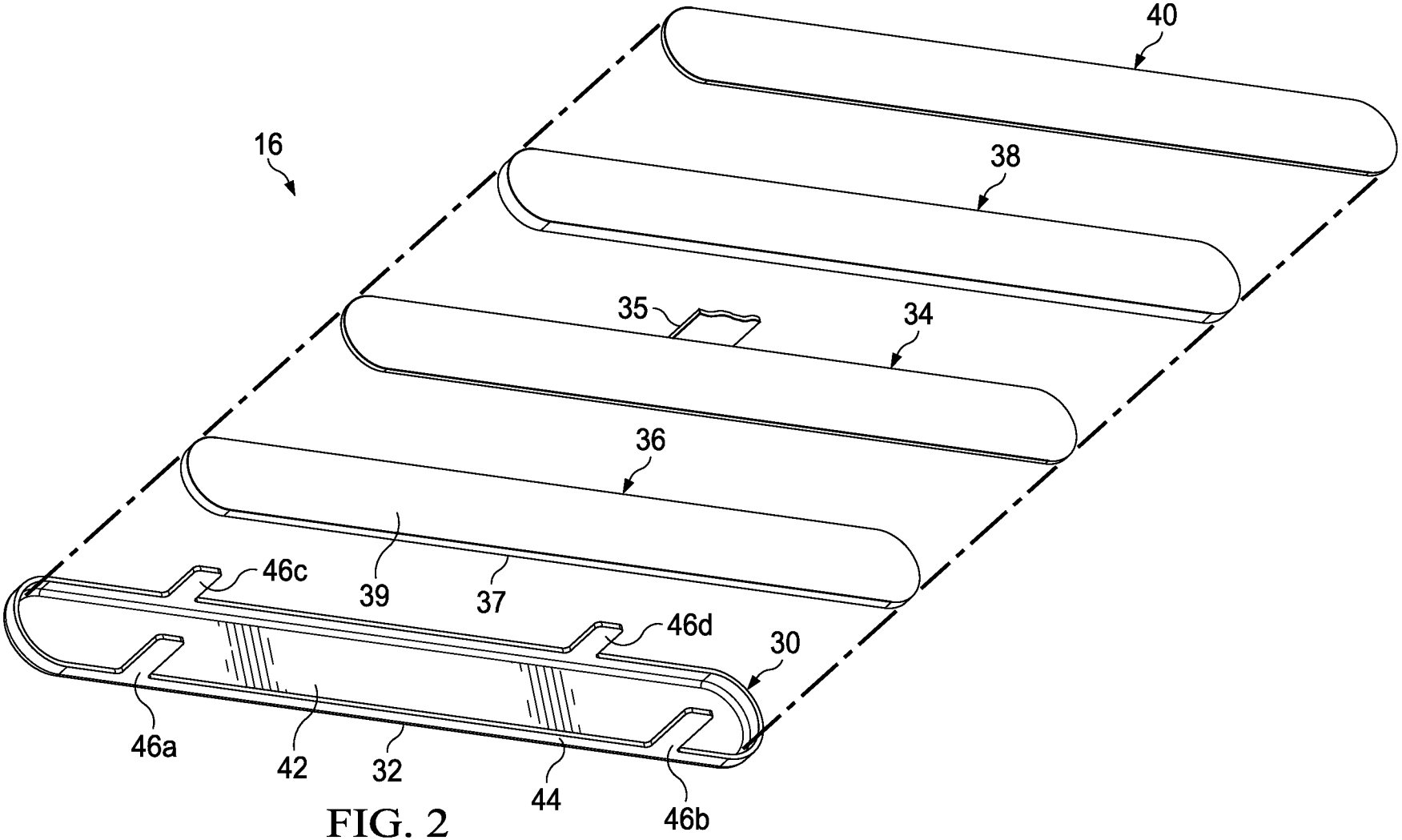
FIG. 2 is an assembly view of one possible embodiment of a heat delivery element that may be incorporated into the shaving razor system of FIG. 1.

Referring to FIG. 2, one possible embodiment of the heat delivery element 16 is shown that may be incorporated into the shaving razor system 10 of FIG. 1. The face plate 30 may be as thin as possible, but stable mechanically. For example, the face plate 30 may have a wall thickness of about 100 micrometers to about 200 micrometers. The face plate 30 may comprise a material having a thermal conductivity of about 10 to 30 W/mK, such as steel. The face plate 30 being manufactured from a thin piece of steel results in the face plate 30 having a low thermal conductivity thus helping minimize heat loss through a perimeter wall 44 and maximizes heat flow towards the skin contacting surface 32. Although a thinner piece of steel is preferred for the above reasons, the face plate 30 may be constructed from a thicker piece of aluminum having a thermal conductivity ranging from about 160 to 200 W/mK. The heat delivery element 16 may include a heater (not shown) having a bridge 35 that is in electrical contact with micro-controller and a power source (not shown), e.g. a rechargeable battery, positioned within the handle 14.

The heat delivery element 16 may include the face plate 30, the heater 34, a heat dispersion layer 36, a compressible thermal insulation layer 38, and a back cover 40. The face plate 30 may have a recessed inner surface 42 opposite the skin contacting surface 32 (see FIG. 1) configured to receive the heater 34, the heat dispersion layer 36 and the compressible thermal insulation layer 38. The perimeter wall 44 may define the inner surface 42. The perimeter wall 44 may have one or more legs 46*a*, 46*b*, 46*c* and 46*d* extending from the perimeter wall 44, transverse to and away from the inner surface 42. For example, FIG. 2 illustrates four legs 46*a*, 46*b*, 46*c* and 46*d* extending from the perimeter wall 44. As will be explained in greater detail below, the heater 34 may include heater tracks and electrical tracks, not shown.

The heat dispersion layer 36 may be positioned on and in direct contact with the inner surface 42 of the face plate 30. The heat dispersion layer 36 may have a lower surface 37 directly contacting the inner surface 42 of the face plate 30 and an upper surface 39 (opposite lower surface 37) directly contacting the heater 34 (for example, the lower dielectric layer shown in FIGS. 3 and 4). The heat dispersion layer 36 is defined as a layer of material having a high thermal conductivity, and is compressible. For example, the heat dispersion layer 36 may comprise graphite foil. Potential advantages of the heat dispersion layer 36 include improving lateral heat flow (spreading the heat delivery from the heater 34 across the inner surface 42 of the face plate 30, which is transferred to the skin contacting surface 32) resulting in more even heat distribution and minimization of hot and cold spots. The heat dispersion layer 36 may have an anisotropic coefficient of thermal conductivity in the plane parallel to the face plate 30 of about 200 to about 1700 W/mK (preferably 400 to 700 W/mK) and vertical to the face plate 30 of about 10 to 50 W/mK and preferably 15 to 25 W/mK to facilitate sufficient heat conduction or transfer.

In addition, the compressibility of the heat dispersion layer 36 allows the heat dispersion layer 36 adapt to non-uniform surfaces of the inner surface 42 of the face plate 30 and non-uniform surfaces of the heater 34, thus providing better contact and heat transfer. The compressibility of the heat dispersion layer 36 also minimizes stray particulates from pushing into the heater 34 (because the heat dispersion layer 36 may be softer than the heater), thus preventing damage to the heater 34. In certain embodiments, the heat dispersion layer 36 may comprise a graphite foil that is compressed by about 20% to about 50% of its original thickness. For example, the heat dispersion layer 36 may have a compressed thickness of about 50 micrometers to about 300 micrometers more preferably 80 to 200 micrometers.

The heater 34 may be positioned between two compressible layers. For example, the heater 34 may be positioned between the heat dispersion layer 36 and the compressible thermal insulation layer 38. The two compressible layers may facilitate clamping the heater 34 in place without damaging the heater 34, thus improving securement and assembly of the heat delivery element 16. The compressible thermal insulation layer 38 may help direct the heat flow toward the face plate 30 and away from the back cover 40. Accordingly, less heat is wasted and more heat may be able to reach the skin during shaving. The compressible thermal insulation layer 38 may have low thermal conductivity, for example, less than 0.30 W/mK and preferably less than 0.1 W/mK. In certain embodiments, the compressible thermal insulation layer 38 may comprise an open cell or closed cellular compressible foam. The compressible thermal insulation layer 38 may be compressed 20-50% from its original thickness. For example, the compressible thermal insulation layer 38 may have a compressed thickness of about 400 μm to about 800 μm.

The back cover 40 may be mounted on top of the compressible thermal insulation layer 38 and secured to the face plate 30. Accordingly, the heater 34, the heat dispersion layer 36 and the compressible thermal insulation layer 38 may be pressed together between the face plate 30 and the back cover 40. The heat dispersion layer 36, the heater 34, and the compressible thermal insulation layer 38 may fit snugly within the perimeter wall 44. The pressing of the various layers together may result in more efficient heat transfer across the interfaces of the different layers in the heat delivery element 16. In absence of this compression force the thermal transfer across the interfaces is insufficient. Furthermore, the pressing of the layers together may also eliminate secondary assembly processes, such as the use of adhesives between the various layers. The compressible thermal insulation layer 38 may fit snugly within the perimeter wall 44.

Figure 3:
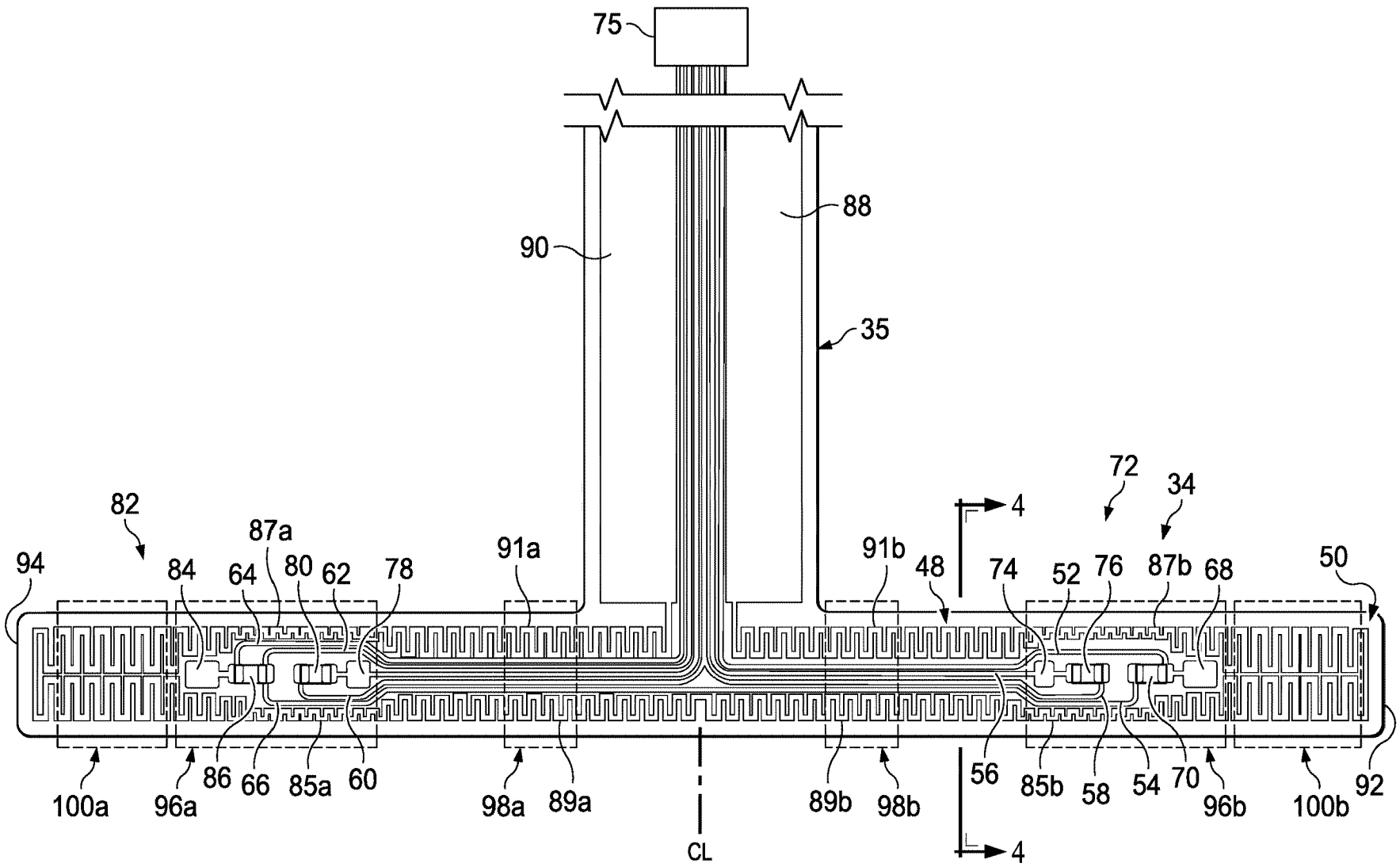
FIG. 3 is a top view of one possible embodiment of a heater that may be incorporated into the heat delivery element of FIG. 2.

Referring to FIG. 3, a top view of the heater 34 is shown. The heater 34 may have a heater track 48 laid over a lower dielectric layer 50. One or more electrical tracks 52, 54, 56, 58, 60, 62, 64 and 66 may also be laid over the lower dielectric layer 50 such that they are all spaced apart from the heater track 48. The one or more electrical tracks 52, 54, 56, 58, 60, 62, 64 and 66 may be positioned within a loop (e.g., perimeter) formed by the heater track 48. The electrical tracks 52, 54, 56, 58, 60, 62, 64 and 66 may connect a plurality of thermal sensors 70, 76, 80 and 86 to a micro controller 75. The microcontroller may process information from the thermal sensors 70, 76, 80 and 86 and adjust power to the heater track 48 to regulate temperature accordingly. The thermal sensor 70 may be thermally connected to a sensor pad 68. Similarly, the thermal sensor 76 may be thermally connected to a sensor pad 74. The thermal sensors 70 and 76 and respective sensor pads 68 and 74 may facilitate temperature control on one side of the heater 34. A thermal sensor pad 84 may be thermally connected to the thermal sensor 86. Similarly, a sensor pad 78 may be thermally connected to the thermal sensor 80. The thermal sensors 80 and 86 and respective sensor pads 78 and 84 may facilitate temperature control on another side of the heater 34. The thermal sensors 70 and 76 may be positioned laterally between the sensor pads 68 and 74. The thermal sensors 80 and 86 may be positioned laterally between the sensor pads 78 and 84. The spacing of the thermal sensors 70, 76, 80 and 86 and the sensor pads 68, 74, 78 and 84 may optimize spacing for more efficient heating of the heater 34.

One or more of the thermal sensors 70, 76, 80 and 86 may be independently connected to the circuit board 75 to provide for redundant safety measure if one or more of the thermal sensors 70, 76, 80 and 86 has a failure. At least one of the thermal sensors 70, 76, 80 and 86 may be spaced apart from the heater track 48 by a distance of about 0.05 mm to about 0.10 mm, which may help prevent direct heating of the thermal sensors 70, 76, 80 and 86 from the heater tracks. In addition, the sensor pads 68, 74, 78 and 84 may also be spaced apart from the heater track 48 to provide an accurate temperature reading of the graphite foil layer shown in FIG. 2. The sensor pads 68, 74, 78 and 84 may improve thermal connection to graphite foil layer to measure temperature quickly and accurately. The sensor pads 68, 74, 78 and 84 may be spaced apart from a lateral edge 92 and 94 of the dielectric layer 50. For example, the sensor pads may be spaced apart from a center line "CL" of the dielectric layer by about 10-30% and from the closest lateral edge 92 and 94 of the dielectric layer 50 by about 10-30%. The spacing and positioning of the sensor pads 68, 74, 78 and 84 may facilitate accurate temperature reading by the thermal sensors 70, 76, 80 and 86. The sensor pads may comprise a layer of copper. In certain embodiments, the sensor pads 68, 74, 78 and 84 may each have a minimum surface area greater than 0.3 $mm^2$, for example, about 0.3 $mm^2$ to about 0.45 $mm^2$. If the surface area of one or more of the sensor pads 68, 74, 78 and 84 is too small, the thermal sensors 70, 76, 80 and 86 may not be able to read small fluctuations in temperature and/or the response time may be longer.

The heater 34 may include a feeder track 88 and 90 that are part of the bridge 35 and connect the micro-controller to the heater track 48. A width of the feeder tracks 88 and 90 may be more than 5 times a maximum width of the heater track 48 positioned within the faceplate 30 of FIG. 2. The large width of the feeder tracks 88 and 90 supplies energy to the heater track 48 and helps prevent the bridge 35 from becoming too hot to the touch by minimizing the electrical resistance and hence the amount of heat generated. The bridge 35 may be exposed to the consumer during shaving in order to facilitate pivoting of the shaving razor cartridge 12 (see FIG. 1). Accordingly, if the bridge 35 becomes too hot, a consumer may be accidentally burned. Furthermore, the bridge 35 may not be insulated to prevent heat loss. Thus, it may be advantageous for the bridge 35 to generate as little heat as possible.

The lower dielectric layer 50 may comprise polyimide or polytetrafluoroethylene, polyvinylchloride, polyester, or polyethylene terephthalate. The heater track 48 may include copper tracks having a meander pattern forming a loop along a perimeter of the lower dielectric layer 50. The heater track 48 may have varying widths. For example, the heater track 48 may have a width of about 0.05 mm to about 0.09 mm in a first area **96*a* and 96*b* of the heater 34 and a width of about 0.07 mm to about 0.12 mm in a second area 98*a* and 98*b* of the heater 34. In certain embodiments, the heater track 48 may have a third area 100***a* and 100*b* having a width of about 0.10 mm to about 0.2 mm. Space may be limited on the lower dielectric layer 50 due to the electrical tracks 52, 54, 56, 58, 60, 62, 64 and 66, the sensor pads 68, 74, 78 and 84 and the thermal sensors 70, 76, 80 and 84. Accordingly, the heat generation should be maximized and uniform as possible. In certain embodiments, the layout of the heater track 48 may be symmetrical. For example, the heater track 48 may have the same layout on a first side 72 of the centerline "CL" as on a second side 82 of the centerline "CL".

The varying width of the heater track 48 allows for lower resistance in areas with more space and higher resistance in area of little space to achieve more uniform heat generation. Accordingly, more an equivalent amount of heat may be generated by the heater track 48 in a smaller space, for example in the first area 96*a* and 96*b*, compared to a larger space, for example, in the second area 98*a* and 98*b*. The second area 98*a* and 98*b* may be positioned toward a center line "CL" of the heater 34. The first area 96*a* may be associated with the thermal sensors 80 and 86 and/or sensor pads 78 and 84 toward one end 94 of the dielectric layer 50. Similarly, the first area 96*b* may be associated with the thermal sensors 70 and 76 and/or sensor pads 68 and 74 on an opposing end of the dielectric layer 50. For example, the sensor pads 78 and 84 and/or the thermal sensors 80 and 86 may be positioned between a pair of lengths 85*a* and 87*a* of the heater track 48 having a smaller width than a width for a length 89*a* and 91*a* of the heater track 48 located in the second area 98*a*. The second area 98*a* and 98*b* may have only the electrical tracks positioned between the length 89*a* and 91*a* of the heater track 48 (e.g., no sensors or sensor pads).

The first area 96*b* may be associated with the thermal sensors 70 and 76 and/or sensor pads 68 and 74 toward one end 92 of the dielectric layer 50. Similarly, the first area 96*b* may be associated with the thermal sensors 70 and 76 and/or sensor pads 68 and 74 on an opposing end of the dielectric layer 50. For example, the sensor pads 68 and 74 and/or the thermal sensors 70 and 76 may be positioned between a pair of lengths 85*b* and 87*b* of the heater track 48 having a smaller width than a width for a length 89*b* and 91*b* of the heater track 48 located in the second area 98*b*. The second area 98*a* and 98*b* on each side of the heater 34 may not have any sensor pads or thermal sensors positioned between the lengths of the heater track 48. For example, in the second area 98*b*, only the electrical tracks 52, 54, 56, 58, 60, 62, 64 and 66 may positioned between the length 89*b* and 91*b* of the heater track 48.

A third area 100*a* and 100*b* may be located toward a lateral edge 92 and 94 of the dielectric layer 50. For example, the third area 100*a* may be positioned between the thermal sensor 86 and the lateral edge 94. Similarly, the third area 100*b* may be positioned on the other side of the dielectric layer 50, between the thermal sensor 70 and the lateral edge 92. The third area 100*a* and 100*b* may lack thermal sensors, thermal pads, and electrical tracks. Accordingly, the heater track 48 in the third area 100*a* and 100*b* may have the widest section of the heater track 48 because the space is not limited by other electrical components. The layout of the first area 96*a* and 96*b*, the second area 98*a* and 98*b* and the third area 100*a* and 100*b* allow for more uniform distribution of heat by having varying widths to account for space that may be needed by other electrical components.

In certain embodiments, the heater track 48 may have a total resistance of about 1.5 to about 3 Ohms. The heater track 48 may have a meander pattern forming a loop along a perimeter of the lower polyamide layer 50. For example, the heater track 48 may extend around the electrical tracks (i.e., the electrical tracks are positioned within a loop formed by the heater track 48), the thermal sensors and the sensor pads. The meander pattern forming a perimeter or loop and the lower resistance in the area of the thermal sensors 70, 76, 80, 86 and the sensor pads 68, 74, 78 and 84 may facilitate delivery of sufficient heat in the area of the sensors because the thermal sensors and sensor pads generate no heat. The meander pattern of the heater track 48 may have the form of a zigzag; veering to right and left alternately. In certain embodiments, meander pattern of the heater track 48 may have a line or course with abrupt substantially 90 degree turns (e.g., train wave or square wave shape), to provide even more heater track 48 within a given area of the heater 34.

Figure 4:
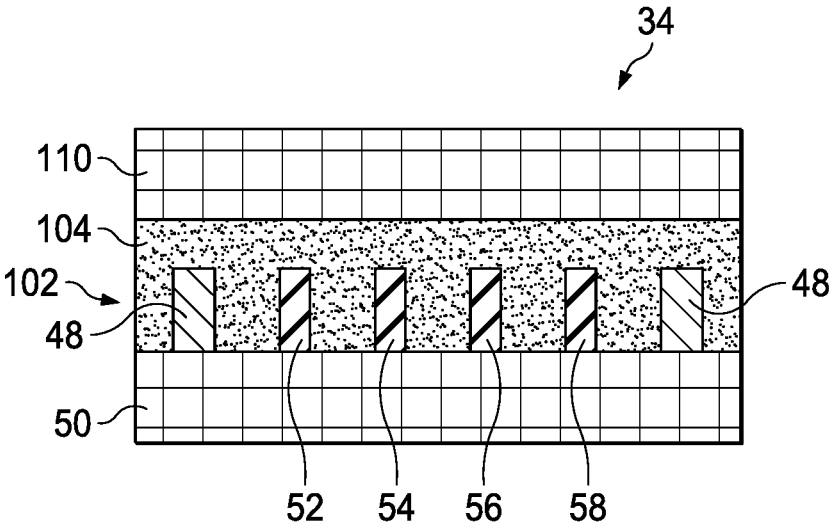
FIG. 4 is a cross section view of the heater, taken generally along line 4-4 of FIG. 3.

Referring to FIG. 4, a cross section view of the heater 34 is shown, taken generally along the line 4-4 of FIG. 3. The heater 34 may include the lower dielectric layer 50, a conductive layer 102 (that comprises the electrical tracks 52, 54, 56 and 58 and the heater track 48) an adhesive layer 104 and an upper dielectric layer 110. The conductive layer 102 may have a thickness of about 10 μm to about 40 μm (i.e., the electrical tracks 52, 54, 56, 58 and the heater tracks 48 have a thickness of about 10 μm to about 40 μm). The lower dielectric layer 50 may have a thickness of about 10 μm to about 30 μm. The upper dielectric layer 110 may have a thickness of about 10 μm to about 30 μm. The conductive layer 102 (comprising the electrical tracks 52, 54, 56 and 58 and the heater track 48) may be laid down on top of the lower dielectric layer 50. Since there are spaces between the electrical tracks 52, 54, 56 and 58 and the heater track 48, the adhesive layer 104 may flow between the electrical tracks 52, 54, 56 and 58 and the heater track 48 to improve integrity of the fragile conductive layer 102. The adhesive layer 104 may form a strong bond between the upper dielectric layer 110 and the lower dielectric layer 50. The adhesive layers 104 may also cover the conductive layer 102 (i.e., the heater track 48 and electrical tracks) creating a water proof seal. The various materials and thickness that make up the heater 34 allow it to bend under its own weight, thus making the heater 34 more malleable and less susceptible to breaking during handling and assembly. In addition, the heater 34 takes up less space due to its thin profile. In certain embodiments, the upper dielectric layer 110 and/or the adhesive layer 104 may be transparent. For example, the heater track 48 may be visible through the upper dielectric layer 110 and the adhesive layer 104, but may be colored, if desired.

The heater 34 may be sufficiently thin to provide flexibility and sufficient heat transfer. If the heater 34 (e.g., the lower dielectric layer 50) is too thick, poor heat transfer may result. The heater 34 may also provide sufficient mechanical stability to allow it to conform during assembly within the face plate 30 of FIG. 2. The lower dielectric layer may prevent electrical contact with other layers of the heat delivery element 16, but yet allow sufficient heat transfer. For example, the lower polyimide dielectric layer may prevent the heater track and the electrical tracks from directly contacting the graphite layer or the inner surface of the face plate 30.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A heat delivery element for a shaving razor comprising:

a heater having a heater track positioned between an upper dielectric layer and a lower dielectric layer, wherein the heater track is secured between the upper dielectric layer and the lower dielectric layer by an adhesive layer bonded to the upper dielectric layer and the lower dielectric layer.

2. The heat delivery element of claim 1 further comprising a face plate configured to receive the heater, the face plate having a skin contacting surface and an opposing inner surface.

3. The heat delivery element of claim 1 wherein the upper dielectric layer or the lower dielectric layer comprises polyimide, polytetrafluoroethylene, polyvinylchloride, polyester, or polyethylene terephthalate.

4. The heat delivery element of claim 1 further comprising an electrical track having at least one thermal sensor connected to at least one sensor pad.

5. The heat delivery element of claim 4 wherein the at least one sensor pad has a minimum surface area of 0.3 $mm^2$.

6. The heat delivery element of claim 4 wherein the thermal sensor is spaced apart from the heater track by a distance of 0.05 mm to 0.10 mm.

7. The heat delivery element of claim 1 wherein the heater track has a width of 0.05 mm to 0.09 mm in a first area and a width of 0.10 mm to 0.2 mm in a second area.

8. The heat delivery element of claim 7 wherein at least one of the thermal sensors positioned adjacent the first area.

9. The heat delivery element of claim 1 wherein the heater track has a meander pattern forming a loop along a perimeter on the lower dielectric layer.

10. The heat delivery element of claim 1 wherein the heater track has a thickness of 10 um to 40 um.

11. The heat delivery element of claim 1 wherein the upper dielectric layer has a thickness of 10 um to 30 um and the lower dielectric layer has a thickness of 10 um to 30 um.

12. The heat delivery element of claim 1 further comprising a pair of thermal sensors positioned laterally between a pair of sensor pads.

13. The heat delivery element of claim 1 further comprising a plurality of thermal sensors connected to a micro controller.

14. The heat delivery element of claim 1 further comprising a feeder track connecting the heater track to a microcontroller, wherein a width of the feeder track is more than 5 times a width of the heater track.

15. The heat delivery element of claim 1 wherein the skin contacting surface of the face plate comprises a hard coating.

16. A heat delivery element for a shaving razor comprising:

a heater having a heater track positioned between an upper dielectric layer and a lower dielectric layer, wherein the heater track is positioned between the upper dielectric layer and the lower dielectric layer; and an electrical track having at least one thermal sensor connected to at least one sensor pad, wherein the at least one sensor pad has a minimum surface area of 0.3 $mm^2$.

17. The heat delivery element of claim 16 wherein the thermal sensor is spaced apart from the heater track by a distance of 0.05 mm to 0.10 mm.

18. A heat delivery element for a shaving razor comprising:

a heater having a heater track positioned between an upper dielectric layer and a lower dielectric layer, wherein the heater track is positioned between the upper dielectric layer and the lower dielectric layer, wherein the heater track has a meander pattern forming a loop along a perimeter on the lower dielectric layer.

19. The heat delivery element of claim 18 further comprising a feeder track connecting the heater track to a microcontroller, wherein a width of the feeder track is more than 5 times a width of the heater track.

20. The heat delivery element of claim 18 wherein the heater track has a width of 0.05 mm to 0.09 mm in a first area and a width of 0.10 mm to 0.2 mm in a second area and at least one thermal sensor is positioned adjacent the first area.

* * * * *